US012264831B2

(12) United States Patent
Wu et al.

(10) Patent No.: US 12,264,831 B2
(45) Date of Patent: Apr. 1, 2025

(54) DEFROSTING CONTROL METHOD AND DEVICE, AND MULTI-SPLIT AIR CONDITIONER

(71) Applicant: Gree Electric Appliances, Inc. of Zhuhai, Guangdong (CN)

(72) Inventors: Lianfa Wu, Guangdong (CN); Mengmeng Jin, Guangdong (CN); Tian Qiu, Guangdong (CN); Chuantao Shen, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 231 days.

(21) Appl. No.: 18/014,892

(22) PCT Filed: Oct. 11, 2021

(86) PCT No.: PCT/CN2021/123085

§ 371 (c)(1),
(2) Date: Jan. 6, 2023

(87) PCT Pub. No.: WO2022/127309

PCT Pub. Date: Jun. 23, 2022

(65) Prior Publication Data

US 2023/0250984 A1 Aug. 10, 2023

(30) Foreign Application Priority Data

Dec. 17, 2020 (CN) ..... 202011494245.6

(51) Int. Cl.
*F24F 11/42* (2018.01)
*F24F 11/61* (2018.01)
*F24F 11/64* (2018.01)

(52) U.S. Cl.
CPC ..... *F24F 11/42* (2018.01); *F24F 11/61* (2018.01); *F24F 11/64* (2018.01)

(58) Field of Classification Search
CPC ..... F24F 11/42; F24F 11/61; F24F 11/64
See application file for complete search history.

(56) References Cited

U.S. PATENT DOCUMENTS 5,832,735 A 11/1998 Matsumoto et al.
5,931,009 A 8/1999 Choi
(Continued)

FOREIGN PATENT DOCUMENTS

CN 101458027 A 6/2009
CN 102878737 A 1/2013
(Continued)

OTHER PUBLICATIONS

Wan, Yongqiang, "Frost analysis and defrost control strategy of multi-online air conditioning system", Guide to Business, Jul. 1, 2016, p. 161, vol. 2016, No. 13. Abstract.
(Continued)

*Primary Examiner* — Kun Kai Ma
(74) *Attorney, Agent, or Firm* — The Webb Law Firm

(57) ABSTRACT

The disclosure provides a defrosting control method and device and a multi-split air conditioner. The defrosting control method including: controlling the multi-split air conditioner to enter a continuous heating and defrosting mode under a condition that any external unit meets the preset defrosting condition; detecting sequentially whether the each external unit in the multi-split air conditioner is currently in a frostless state; marking directly a currently detected external unit as having finished defrosting under a condition that the currently detected external unit is currently in a frostless state; defrosting the currently detected external unit under a condition that the currently detected external unit is currently in a frosted state, and marking the currently detected external unit as having finished defrosting after defrosting; and controlling the multi-split air condi-
(Continued)

tioner to exit the mode under a condition that all the external units are marked as having finished defrosting.

14 Claims, 3 Drawing Sheets

(56) References Cited

U.S. PATENT DOCUMENTS

| | | | |
|---|---|---|---|
| 2020/0132323 | A1 | 4/2020 | Li |
| 2020/0208890 | A1 | 7/2020 | Zhuo et al. |

FOREIGN PATENT DOCUMENTS

| | | | | | |
|---|---|---|---|---|---|
| CN | 102997368 | A | | 3/2013 | |
| CN | 103206836 | A | | 7/2013 | |
| CN | 103363614 | A | | 10/2013 | |
| CN | 104061650 | A | | 9/2014 | |
| CN | 104279698 | A | | 1/2015 | |
| CN | 104296414 | A | | 1/2015 | |
| CN | 204693603 | U | | 10/2015 | |
| CN | 204693914 | U | * | 10/2015 | |
| CN | 105202834 | A | | 12/2015 | |
| CN | 105387560 | A | | 3/2016 | |
| CN | 106052229 | A | | 10/2016 | |
| CN | 106288162 | A | | 1/2017 | |
| CN | 106705347 | A | | 5/2017 | |
| CN | 106766437 | A | | 5/2017 | |
| CN | 107084507 | A | | 8/2017 | |
| CN | 104764111 | B | * | 4/2018 | ..... F24F 1/06 |
| CN | 108302651 | A | | 7/2018 | |
| CN | 108759150 | A | * | 11/2018 | ..... F25B 13/00 |
| CN | 109469963 | A | | 3/2019 | |
| CN | 109506401 | A | | 3/2019 | |
| CN | 109751714 | A | | 5/2019 | |
| CN | 109945330 | A | | 6/2019 | |
| CN | 209165824 | U | | 7/2019 | |
| CN | 110094831 | A | | 8/2019 | |
| CN | 110173821 | A | | 8/2019 | |
| CN | 110195921 | A | | 9/2019 | |
| CN | 110469958 | A | * | 11/2019 | |
| CN | 110500713 | A | | 11/2019 | |
| CN | 110715481 | A | | 1/2020 | |
| CN | 110986284 | A | | 4/2020 | |
| CN | 111306832 | A | | 6/2020 | |
| CN | 111322784 | A | | 6/2020 | |
| CN | 111397261 | A | | 7/2020 | |
| CN | 111720952 | A | * | 9/2020 | |
| CN | 112539520 | A | | 3/2021 | |
| EP | 3064867 | A2 | | 9/2016 | |
| EP | 3225930 | A1 | | 10/2017 | |
| EP | 3258190 | A1 | | 12/2017 | |
| JP | H03175228 | A | | 7/1991 | |
| JP | H09287856 | A | * | 11/1997 | |
| JP | H09296972 | A | | 11/1997 | |
| JP | H1123112 | A | | 1/1999 | |
| JP | 2877552 | B2 | * | 3/1999 | |
| JP | 3423031 | B2 | * | 7/2003 | |
| JP | 2005049022 | A | | 2/2005 | |
| KR | 19990074270 | A | | 10/1999 | |
| WO | 2019015444 | A1 | | 1/2019 | |
| WO | WO-2019128356 | A1 | * | 7/2019 | |
| WO | 2019158048 | A1 | | 8/2019 | |
| WO | 2019227911 | A1 | | 12/2019 | |

OTHER PUBLICATIONS

Extended European Search Report, EP 21905238.8, Nov. 23, 2023.

* cited by examiner

DEFROSTING CONTROL METHOD AND DEVICE, AND MULTI-SPLIT AIR CONDITIONER

CROSS-REFERENCE TO RELATED APPLICATIONS

This application is the United States National Stage of International Application No. PCT/CN2021/123085 filed on Oct. 11, 2021, and claims priority to Chinese Patent Application No. 202011494245.6 filed on Dec. 17, 2020, the disclosures of which are hereby incorporated by reference in their entireties.

BACKGROUND OF THE INVENTION

Field of the Invention

The disclosure relates to the field of control, in particular to a defrosting control method and device and a multi-split air conditioner.

Description of Related Art

In the related art, a multi-split air conditioner is provided with a plurality of outer units, and defrosting treatment is performed by respectively controlling the outer units, such that continuous heating of the inner unit can be ensured while defrosting, and a continuous heating and defrosting function can be realized.

SUMMARY OF THE INVENTION

According to a first aspect of an embodiment of the present disclosure, there is provided a defrosting control method comprising: detecting whether each external unit of external units in a multi-split air conditioner meets a preset defrosting condition; controlling the multi-split air conditioner to enter a continuous heating and defrosting mode under a condition that any external unit meets the preset defrosting condition; detecting sequentially whether the each external unit in the multi-split air conditioner is currently in a frostless state according to a sequence of priority levels of the external units in a descending order; marking directly a currently detected external unit as having finished defrosting under a condition that the currently detected external unit is currently in a frostless state; defrosting the currently detected external unit under a condition that the currently detected external unit is currently in a frosted state, and marking the currently detected external unit as having finished defrosting after defrosting; and controlling the multi-split air conditioner to exit the continuous heating and defrosting mode under a condition that all the external units are marked as having finished defrosting.

According to a second aspect of an embodiment of the present disclosure, there is provided a defrosting control device comprising: a processor; and a memory coupled to the processor, storing program instructions which, when executed by the processor, cause the processor to implement the method according to any one of the embodiments mentioned above.

According to a third aspect of an embodiment of the present disclosure, there is provided a multi-split air conditioner comprising: the defrosting control device according to any one of the embodiments mentioned above.

According to a fourth aspect of the embodiments of the present disclosure, there is a computer-readable storage medium storing computer instructions which, when executed by a processor, implements the method according to any one of the embodiments described above.

Other features of the present disclosure and advantages thereof will become apparent from the following detailed description of exemplary embodiments thereof, which proceeds with reference to the accompanying drawings.

BRIEF DESCRIPTION OF THE DRAWINGS

The accompanying drawings, which are incorporated in and constitute a part of this specification, illustrate embodiments of the disclosure and together with the description, serve to explain the principles of the disclosure.

The present disclosure may be more clearly understood from the following detailed description taken in conjunction with the accompanying drawings, in which.

It should be understood that the dimensions of the various parts shown in the drawings are not drawn to scale. Further, the same or similar reference numerals denote the same or similar components.

DESCRIPTION OF THE INVENTION

Various exemplary embodiments of the present disclosure will now be described in detail with reference to the accompanying drawings. The description of the exemplary embodiments is merely illustrative and is in no way intended to limit the disclosure, its application, or uses. The present disclosure may be embodied in many different forms and is not limited to the embodiments described herein. These embodiments are provided so that this disclosure will be thorough and complete, and will fully convey the scope of the disclosure to those skilled in the art. It should be noted that: the relative arrangement of parts and steps, the composition of materials and values set forth in these embodiments are to be construed as illustrative only and not as limiting unless otherwise specifically stated.

The use of "including" or "comprising" and the like in this disclosure is intended to mean that the elements preceding the word encompass the elements listed after the word and does not exclude the possibility that other elements may also be encompassed.

All terms (including technical or scientific terms) used herein have the same meaning as commonly understood by one of ordinary skill in the art to which this disclosure belongs unless specifically defined otherwise. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Techniques, methods, and apparatus known to one of ordinary skill in the relevant art may not be discussed in detail but are intended to be part of the specification where appropriate.

The inventors found that, in the prior art, in the continuous heating and defrosting process of the multi-split air conditioner, all external units are controlled to perform sequentially defrosting treatment until all the external units complete the defrosting treatment. For an external unit which is not in a frosted state, defrosting treatment is still required, such that the whole defrosting period is prolonged, energy consumption is wasted, and heating comfort is reduced.

Accordingly, the present disclosure provides a solution of defrosting control which can effectively shorten the defrosting time.

Figure 1:
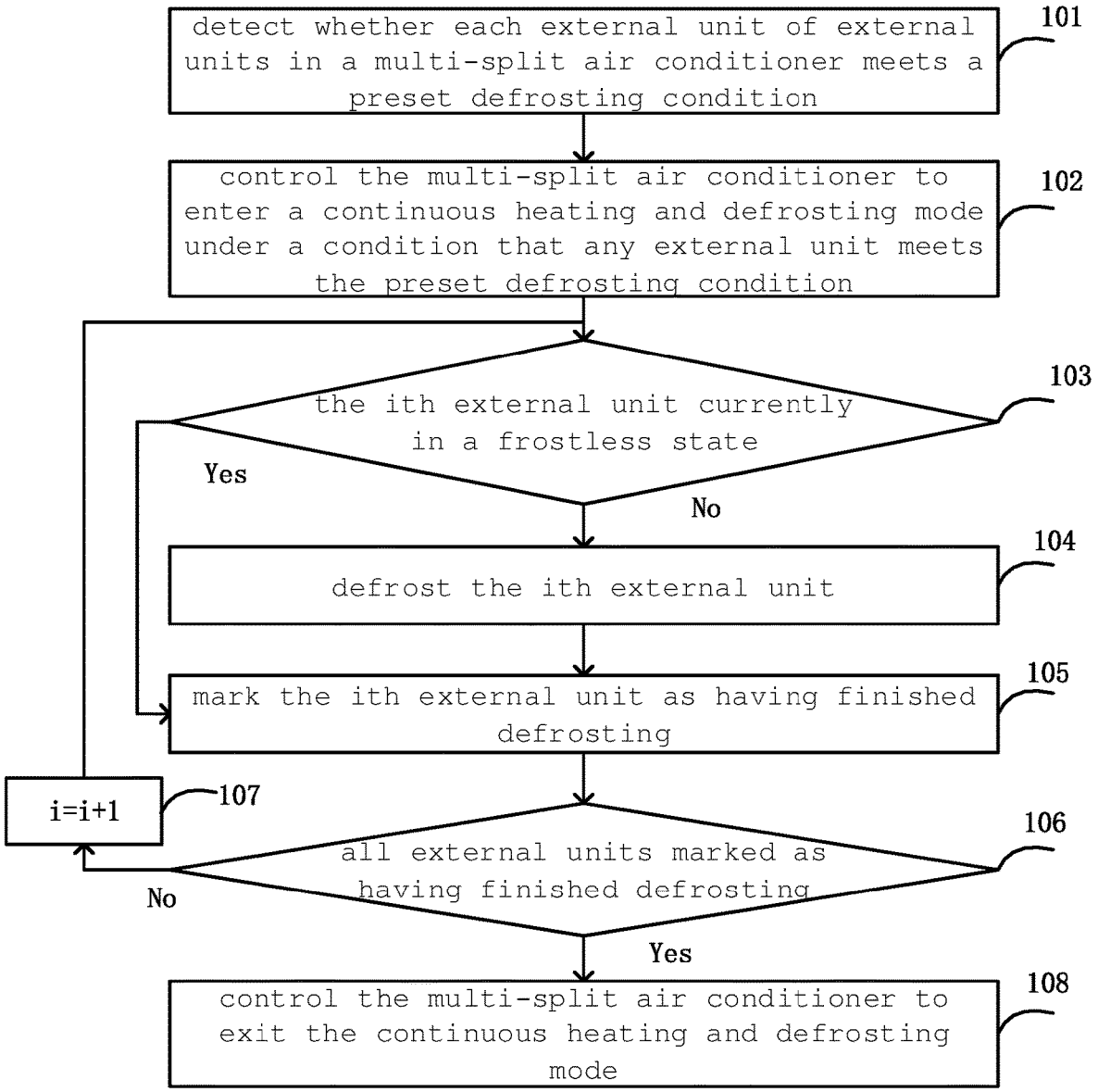
FIG. 1 is a schematic flow chart diagram of a defrosting control method according to one embodiment of the present disclosure.

FIG. 1 is a schematic flowchart of a defrosting control method according to one embodiment of the present disclosure. In some embodiments, the following steps of the defrosting control method are performed by a defrosting control device.

In step 101, it is detected whether each external unit of external units in a multi-split air conditioner meets a preset defrosting condition.

It should be noted that, since the preset defrosting condition of the outer unit module is not the inventive point of the present disclosure, it is not described herein.

In step 102, the multi-split air conditioner is controlled to enter a continuous heating and defrosting mode under a condition that any external unit meets the preset defrosting condition.

In step 103, in the continuous heating and defrosting mode, it is detected sequentially whether the each external unit in the multi-split air conditioner is currently in a frostless state according to a sequence of priority levels of the external units in a descending order.

Figure 2:
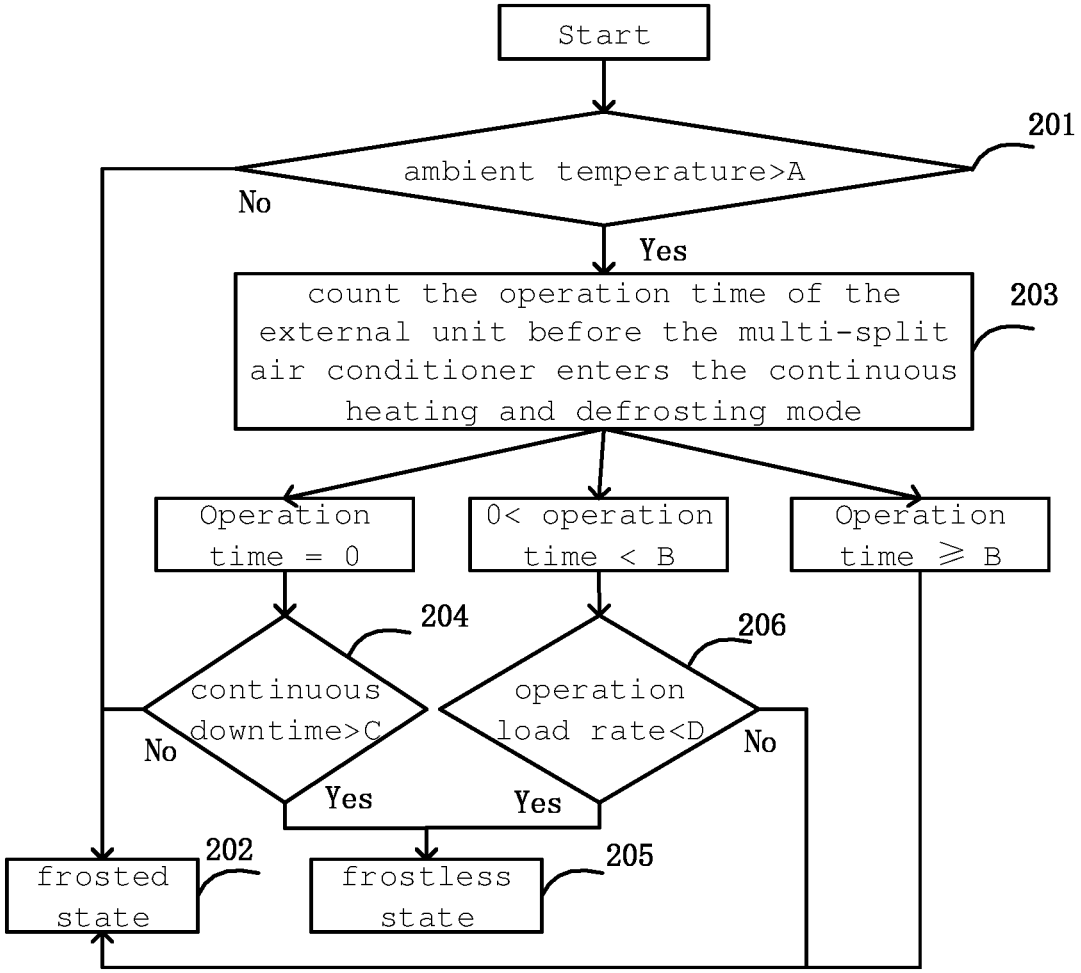
FIG. 2 is a schematic flow chart diagram of a defrosting control method according to another embodiment of the disclosure.

In some embodiments, the embodiment shown in FIG. 2 may be used to detect whether each external unit is currently in a frostless state.

Under a condition that the ith external unit is currently in a frosted state, step 104 is executed. Under a condition that the ith external unit is currently in a frostless state, step 105 is executed. $1 \leq i \leq N$, where N is the total number of the external units of the multi-split system.

In step 104, the ith external unit is defrosted.

In step 105, the ith external unit is marked as having finished defrosting.

In step 106, it is detected whether all the external units are marked as having finished defrosting.

Under a condition that all the external units are not marked as having finished defrosting, step 107 is executed; otherwise, step 108 is executed.

In step 107, let $i=i+1$, and return to step 103 to process the next external unit.

In step 108, the multi-split air conditioner is controlled to exit the continuous heating and defrosting mode.

In the defrosting control method provided in the above embodiment of the present disclosure, in the process of detecting sequentially each external unit in the multi-split air conditioning system, the defrosting process is not performed on the current external unit under a condition that the current external unit is in a frostless state. Therefore, the defrosting time is effectively shortened, the energy consumption waste is effectively reduced, and the heating comfort level is improved.

FIG. 2 is a schematic flowchart of a defrosting control method according to another embodiment of the present disclosure. In some embodiments, the following steps of the defrosting control method are performed by a defrosting control device, wherein the detecting whether each external unit is currently in a frostless state comprises the following steps:

In step 201, it is detected whether an ambient temperature of the currently detected external unit is greater than a preset temperature threshold A.

Under a condition that the ambient temperature of the currently detected external unit is not greater than the preset temperature threshold A, step 202 is executed. Under a condition that the ambient temperature of the currently detected external unit is greater than the preset temperature threshold A, step 203 is executed.

In step 202, it is determined that the currently detected external unit is currently in a frosted state.

In step 203, the operation time of the currently detected external unit before the multi-split air conditioner enters the continuous heating and defrosting mode is counted.

Under a condition that the operation time is 0, step 204 is executed. Under a condition that the operation time is less than the preset operation time threshold B, step 206 is executed. Under a condition that the operation time is not less than the predetermined operation time threshold B, step 202 is executed.

In step 204, it is detected whether the continuous downtime of the currently detected external unit is greater than a preset downtime threshold C.

Under a condition that the continuous downtime is greater than the preset downtime threshold C, step 205 is executed. Under a condition that the continuous downtime is not greater than the preset downtime threshold, step 202 is executed.

In step 205, it is determined that the currently detected external unit is currently in a frostless state.

In step 206, it is detected whether the currently detected operation load rate of the external unit is smaller than a preset load rate threshold D.

Under a condition that the operation load rate is smaller than the predetermined load rate threshold D, step 205 is executed. Under a condition that the operation load rate is not less than the preset load rate threshold D, step 202 is executed.

Figure 3:
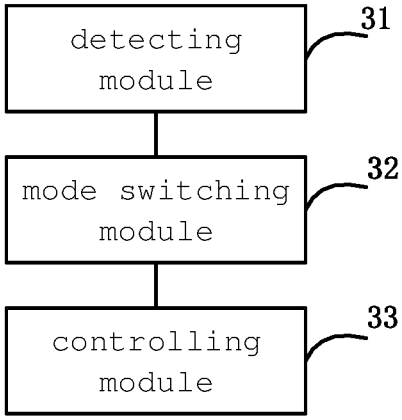
FIG. 3 is a schematic structural diagram of a defrosting control device according to one embodiment of the present disclosure.

FIG. 3 is a schematic structural view of a defrosting control device according to an embodiment of the present disclosure. As shown in FIG. 3, the defrosting control means includes a detecting module 31, a mode switching module 32, and a controlling module 33.

The detecting module 31 is configured to detect whether each external unit of external units in a multi-split air conditioner meets a preset defrosting condition.

The mode switching module 32 is configured to control the multi-split air conditioner to enter a continuous heating and defrosting mode under a condition that any external unit meets the preset defrosting condition.

The controlling module 33 is configured to detect sequentially whether the each external unit in the multi-split air conditioner is currently in a frostless state according to a sequence of priority levels of the external units in a descending order, mark directly a currently detected external unit as having finished defrosting under a condition that the currently detected external unit is currently in a frostless state, and defrost the currently detected external unit under a condition that the currently detected external unit is currently in a frosted state, and marking the currently detected external unit as having finished defrosting after defrosting.

The mode switching module 32 is further configured to control the multi-split air conditioner to exit the continuous heating and defrosting mode under a condition that all the external units are marked as having finished defrosting.

In the defrosting control device provided in the above embodiment of the present disclosure, in the process of detecting sequentially each external unit in the multi-split air conditioning system, the defrosting process is not performed on the current external unit under a condition that the current external unit is in a frostless state. Therefore, the defrosting time is effectively shortened, the energy consumption waste is effectively reduced, and the heating comfort level is improved.

In some embodiments, the controlling module 33 is configured to detect whether an ambient temperature of the currently detected external unit is greater than a preset temperature threshold, count an operation time of the currently detected external unit before the multi-split air conditioner enters the continuous heating and defrosting mode under a condition that the ambient temperature of the currently detected external unit is greater than the preset temperature threshold, detect whether a continuous downtime of the currently detected external unit is greater than a preset downtime threshold under a condition that the operation time is 0, and determine the currently detected external unit is currently in a frostless state under a condition that the continuous downtime is greater than the preset downtime threshold.

In some embodiments, the controlling module 33 is further configured to determine the currently detected external unit is currently in a frosted state under a condition that the continuous downtime is not greater than the preset downtime threshold.

In some embodiments, the controlling module 33 is further configured to detect whether an operation load rate of the currently detected external unit is less than a preset load rate threshold under a condition that the operation time is less than a preset operation time threshold, and determine the currently detected external unit is currently in a frostless state under a condition that the operation load rate is less than the preset load rate threshold.

In some embodiments, the controlling module 33 is further configured to determine the currently detected external unit is currently in a frosted state under a condition that the operation load rate is not less than the preset load rate threshold.

In some embodiments, the controlling module 33 is further configured to determine the currently detected external unit is currently in a frosted state under a condition that the operation time is not less than a preset operation time threshold.

In some embodiments, the controlling module 33 is further configured to determine the currently detected external unit is currently in a frosted state under a condition that the ambient temperature of the currently detected external unit is not greater than the preset temperature threshold.

Figure 4:
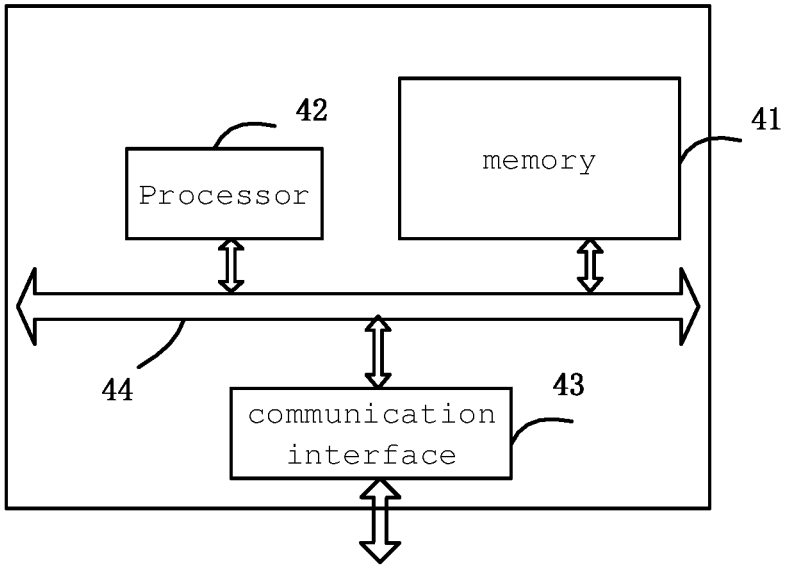
FIG. 4 is a schematic structural diagram of a defrosting control device according to another embodiment of the present disclosure.

FIG. 4 is a schematic structural view of a defrosting control device according to another embodiment of the present disclosure. As shown in FIG. 4, the defrosting control device includes a memory 41 and a processor 42.

The memory 41 is used for storing instructions, the processor 42 is coupled to the memory 41, and the processor 42 is configured to execute the method according to any one of the embodiments in FIG. 1 or FIG. 2 based on the instructions stored in the memory.

As shown in FIG. 4, the defrosting control device further includes a communication interface 43 for information interaction with other devices. Meanwhile, the defrosting control device further comprises a bus 44, through which the processor 42, the communication interface 43 and the memory 41 are communicated with each other.

The memory 41 may comprise high-speed RAM memory, and may also include non-volatile memory, such as at least one disk memory. The memory 41 may also be a memory array. The storage 41 may also be partitioned into blocks, and the blocks may be combined into virtual volumes according to certain rules.

Further, the processor 42 may be a central processing unit CPU, or may be an application specific integrated circuit ASIC, or one or more integrated circuits configured to implement embodiments of the present disclosure.

The present disclosure also relates to a computer-readable storage medium, wherein the computer-readable storage medium stores computer instructions which, when executed by a processor, implement the method according to any one of the embodiments in FIG. 1 or FIG. 2.

Figure 5:
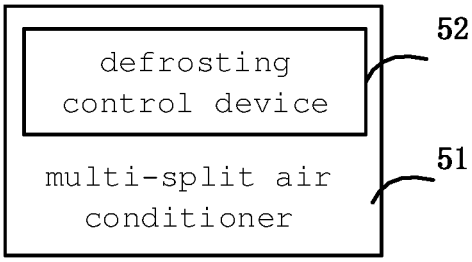
FIG. 5 is a schematic structural view of a multi-split air conditioner according to an embodiment of the present disclosure.

FIG. 5 is a schematic structural view of a multi-split air conditioner according to an embodiment of the present disclosure. As shown in FIG. 5, the multi-split air conditioner 51 is provided with a defrosting control device 52. The defrosting control device 52 is the defrosting control device according to any one of the embodiments of FIG. 3 or 4.

In some embodiments, the functional unit modules described above can be implemented as a general purpose processor, a programmable logic controller (PLC), a digital signal processor (DSP), an application specific integrated circuit (ASIC), a field programmable gate array (FPGA) or other programmable logic device, discrete gate or transistor logic, discrete hardware components, or any suitable combination thereof for performing the functions described in this disclosure.

So far, embodiments of the present disclosure have been described in detail. Some details well known in the art have not been described in order to avoid obscuring the concepts of the present disclosure. Those skilled in the art can now fully appreciate how to implement the teachings disclosed herein, in view of the foregoing description.

Although some specific embodiments of the present disclosure have been described in detail by way of example, it should be understood by those skilled in the art that the above examples are for illustration only and are not intended to limit the scope of the present disclosure. It will be understood by those skilled in the art that various changes may be made and equivalents may be substituted for elements thereof without departing from the scope and spirit of the present disclosure. The scope of the present disclosure is defined by the appended claims.

What is claimed is:

1. A defrosting control method, comprising:

detecting whether each external heat exchanger of external heat exchangers in a multi-split air conditioner meets a preset defrosting condition;

controlling the multi-split air conditioner to enter a continuous heating and defrosting mode under a condition that any external heat exchanger meets the preset defrosting condition;

detecting sequentially whether the each external heat exchanger in the multi-split air conditioner is currently in a frostless state according to a sequence of priority levels of the external heat exchangers in a descending order;

marking directly a currently detected external heat exchanger as having finished defrosting under a condition that the currently detected external heat exchanger is currently in a frostless state;

defrosting the currently detected external heat exchanger under a condition that the currently detected external heat exchanger is currently in a frosted state, and marking the currently detected external heat exchanger as having finished defrosting after defrosting; and controlling the multi-split air conditioner to exit the continuous heating and defrosting mode under a condition that all the external heat exchangers are marked as having finished defrosting, wherein detecting whether each external heat exchanger is currently in a frostless state comprises:

detecting whether an ambient temperature of the currently detected external heat exchanger is greater than a preset temperature threshold;

counting an operation time of the currently detected external heat exchanger before the multi-split air conditioner enters the continuous heating and defrosting mode under a condition that the ambient temperature of the currently detected external heat exchanger is greater than the preset temperature threshold;

detecting whether a continuous downtime of the currently detected external heat exchanger is greater than a preset downtime threshold under a condition that the operation time is 0; and determining the currently detected external heat exchanger is currently in a frostless state under a condition that the continuous downtime is greater than the preset downtime threshold.

2. The defrosting control method according to claim 1, wherein the detecting whether the each external heat exchanger is currently in a frostless state comprises:

determining the currently detected external heat exchanger is currently in a frosted state under a condition that the continuous downtime is not greater than the preset downtime threshold.

3. The defrosting control method according to claim 1, wherein the detecting whether the each external heat exchanger is currently in a frostless state comprises:

detecting whether an operation load rate of the currently detected external heat exchanger is less than a preset load rate threshold under a condition that the operation time is less than a preset operation time threshold; and determining the currently detected external heat exchanger is currently in a frostless state under a condition that the operation load rate is less than the preset load rate threshold.

4. The defrosting control method according to claim 3, wherein the detecting whether the each external heat exchanger is currently in a frostless state comprises:

determining the currently detected external heat exchanger is currently in a frosted state under a condition that the operation load rate is not less than the preset load rate threshold.

5. The defrosting control method according to claim 1, wherein the detecting whether the each external heat exchanger is currently in a frostless state comprises:

determining the currently detected external heat exchanger is currently in a frosted state under a condition that the operation time is not less than a preset operation time threshold.

6. The defrosting control method according to claim 1, wherein the detecting whether the each external heat exchanger is currently in a frostless state comprises:

determining the currently detected external heat exchanger is currently in a frosted state under a condition that the ambient temperature of the currently detected external heat exchanger is not greater than the preset temperature threshold.

7. A non-transitory computer readable storage medium storing computer instructions which, when executed by a processor, implement the defrosting control method of claim 1.

8. A defrosting control device, comprising:

a processor; and a memory coupled to the processor, storing program instructions which, when executed by the processor, cause the processor to:

detect whether each external heat exchanger of external heat exchangers in a multi-split air conditioner meets a preset defrosting condition;

control the multi-split air conditioner to enter a continuous heating and defrosting mode under a condition that any external heat exchanger meets the preset defrosting condition;

detect sequentially whether the each external heat exchanger in the multi-split air conditioner is currently in a frostless state according to a sequence of priority levels of the external heat exchangers in a descending order;

mark directly a currently detected external heat exchanger as having finished defrosting under a condition that the currently detected external heat exchanger is currently in a frostless state;

defrost the currently detected external heat exchanger under a condition that the currently detected external heat exchanger is currently in a frosted state, and mark the currently detected external heat exchanger as having finished defrosting after defrosting; and control the multi-split air conditioner to exit the continuous heating and defrosting mode under a condition that all the external heat exchangers are marked as having finished defrosting, wherein detecting sequentially whether each external heat exchanger in the multi-split air conditioner is currently in a frostless state according to a sequence of priority levels of the external heat exchangers in a descending order, causes the processor to:

detect whether an ambient temperature of the currently detected external heat exchanger is greater than a preset temperature threshold;

count an operation time of the currently detected external heat exchanger before the multi-split air conditioner enters the continuous heating and defrosting mode under a condition that the ambient temperature of the currently detected external heat exchanger is greater than the preset temperature threshold;

detect whether a continuous downtime of the currently detected external heat exchanger is greater than a preset downtime threshold under a condition that the operation time is 0; and determine the currently detected external heat exchanger is currently in a frostless state under a condition that the continuous downtime is greater than the preset downtime threshold.

9. The defrosting control device according to claim 8, wherein the processor is configured to:

determine the currently detected external heat exchanger is currently in a frosted state under a condition that the continuous downtime is not greater than the preset downtime threshold.

10. The defrosting control device according to claim 8, wherein the processor is configured to:

detect whether an operation load rate of the currently detected external heat exchanger is less than a preset load rate threshold under a condition that the operation time is less than a preset operation time threshold; and determine the currently detected external heat exchanger is currently in a frostless state under a condition that the operation load rate is less than the preset load rate threshold.

11. The defrosting control device according to claim 10, wherein the processor is configured to:

determine the currently detected external heat exchanger is currently in a frosted state under a condition that the operation load rate is not less than the preset load rate threshold.

12. The defrosting control device according to claim 8, wherein the processor is configured to:

determine the currently detected external heat exchanger is currently in a frosted state under a condition that the operation time is not less than a preset operation time threshold.

13. The defrosting control device according to claim 8, wherein the processor is configured to:

determine the currently detected external heat exchanger is currently in a frosted state under a condition that the ambient temperature of the currently detected external heat exchanger is not greater than the preset temperature threshold.

14. A multi-split air conditioner, comprising:

the defrosting control device, comprising:

a processor; and a memory coupled to the processor, storing program instructions which, when executed by the processor, cause the processor to:

detect whether each external heat exchanger of external heat exchangers in a multi-split air conditioner meets a preset defrosting condition;

control the multi-split air conditioner to enter a continuous heating and defrosting mode under a condition that any external heat exchanger meets the preset defrosting condition;

detect sequentially whether the each external heat exchanger in the multi-split air conditioner is currently in a frostless state according to a sequence of priority levels of the external heat exchangers in a descending order;

mark directly a currently detected external heat exchanger as having finished defrosting under a condition that the currently detected external heat exchanger is currently in a frostless state;

defrost the currently detected external heat exchanger under a condition that the currently detected external heat exchanger is currently in a frosted state, and mark the currently detected external heat exchanger as having finished defrosting after defrosting; and control the multi-split air conditioner to exit the continuous heating and defrosting mode under a condition that all the external heat exchangers are marked as having finished defrosting, wherein detecting sequentially whether each external heat exchanger in the multi-split air conditioner is currently in a frostless state according to a sequence of priority levels of the external heat exchangers in a descending order, causes the processor to:

detect whether an ambient temperature of the currently detected external heat exchanger is greater than a preset temperature threshold;

count an operation time of the currently detected external heat exchanger before the multi-split air conditioner enters the continuous heating and defrosting mode under a condition that the ambient temperature of the currently detected external heat exchanger is greater than the preset temperature threshold;

detect whether a continuous downtime of the currently detected external heat exchanger is greater than a preset downtime threshold under a condition that the operation time is 0; and determine the currently detected external heat exchanger is currently in a frostless state under a condition that the continuous downtime is greater than the preset downtime threshold.

* * * * *